United States Patent [19]

Schroder

[11] Patent Number: 4,735,294

[45] Date of Patent: Apr. 5, 1988

[54] ELEVATOR GROUP CONTROL FOR THE DISTRIBUTION OF TRAFFIC AT A MAIN FLOOR

[75] Inventor: Joris Schroder, Lucerne, Switzerland

[73] Assignee: Inventio AG, Switzerland

[21] Appl. No.: 49,470

[22] Filed: May 14, 1987

[30] Foreign Application Priority Data

Jun. 10, 1986 [CH] Switzerland ..... 02348/86

[51] Int. Cl.[4] ..... B66B 1/14

[52] U.S. Cl. ..... 187/121; 187/125

[58] Field of Search ..... 187/121, 125, 127, 135, 187/138

[56] References Cited

U.S. PATENT DOCUMENTS

| | | | |
|---|---|---|---|
| 3,374,864 | 3/1968 | Port | 187/121 |
| 3,746,131 | 7/1973 | Hirasawa et al. | 187/121 X |
| 4,600,087 | 7/1986 | Tsuji | 187/121 |
| 4,691,808 | 9/1987 | Nowak et al. | 187/127 X |

*Primary Examiner*—William M. Shoop, Jr.
*Assistant Examiner*—W. E. Duncanson, Jr.
*Attorney, Agent, or Firm*—Marshall & Melhorn

[57] ABSTRACT

A group elevator control wherein the calls entered by means of call registering devices at a main floor for desired destination floors are assigned to the next arriving or already present car, and indicated so that no doubts can arise for passengers, whose calls had been acknowledged, in the choice of the correct car. A locking circuit responds to the presence of several cars at the main floor by only opening the doors of one elevator and assigning the entered calls to this elevator. The call registering devices are blocked at a time dependent on the start of the door closure or after the entering of a certain number of calls, by means of an inhibiting circuit and released again at the departure of the respective car. During the retention cycle, an indicator element, arranged in an indicator panel of the call registering devices, signals the blocking.

10 Claims, 2 Drawing Sheets

ELEVATOR GROUP CONTROL FOR THE DISTRIBUTION OF TRAFFIC AT A MAIN FLOOR

BACKGROUND OF THE INVENTION

The invention relates to an apparatus for the control of elevators in general, and, in particular to the distribution of traffic at a main floor in elevator groups with cars accessible by way of automatically controllable doors and having a group control circuit.

Elevators with control programs for upward peak traffic are typically installed, for instance, in high rise office buildings or other business buildings where it is intended to occupy or fill the building at the start of work in the shortest possible time. As it can be seen, for example, from the U.S. Pat. No. 2,492,010, the cars are readied at the main floor, which in this case is the ground floor, and dispatched at full load or in certain time intervals in the upward direction. After servicing the highest call, the cars return to the main floor, during which travel, depending on the control program, any downward calls are serviced to their full extent in a reduced manner, or not at all. The control program for the upward peak traffic can be triggered by means of traffic monitoring devices, as is known for example from Swiss Pat. No. 342,352.

If, as is generally customary, call buttons are arranged in the cars of the above described elevators, it is assured that the passengers entering at the main floor will reach the inputted destination floor. A group control is disclosed in the U.S. Pat. No. 3,374,864 in which, however, the desired destination floor can be inputted at the floor of entry. For this purpose, call buttons for all the other floors are arranged at the floors, while no call buttons are provided in the cars. The control for three floors and two elevators works in such a manner that the car destined for a destination floor, on arrival at the entry floor, makes known the destination floor by an optical indicating device in the form of the floor number, so that no passengers enter erroneously who would like to travel to other destination floors. When using such a call inputting technology for elevator groups with control programs for upward peak traffic, difficulties arise in the distribution of traffic at the main floor, especially in buildings with many floors and a large amount of traffic. These difficulties are caused in the assignment of the calls to the cars and the display of corresponding information to the passengers, and for which the last mentioned publication does not offer a solution.

It is therefore, a purpose of the present invention to create a control in which the assignment of the calls to the main floor during the upward peak traffic takes place in such a way, that the passengers waiting at the main floor can recognize rapidly and without effort, even in the case of larger elevator installations and a high amount of traffic, whether calls inputted by them are assigned to an arriving or a departure ready car, or not.

SUMMARY OF THE INVENTION

The present invention concerns a group elevator control having a locking circuit which has the effect that in the presence of several cars at the main floor, only the doors of one elevator can be opened and the calls inputted at the main floor are assigned to this elevator. The call registering devices are inhibited at a point in time dependent on the beginning of the door closure or after input of a certain number of calls by means of a blocking circuit and are released again at the departure of the respective car. During the blocking period or retention cycle, an indicating element, arranged in an indicator panel of the call registering device and indicating the blocking, is activated.

The advantages of the present invention are due to the simple method of call assignment, where double assignments are avoided and no calls are lost. A further advantage can be found in the signal indicating the blocking of the call registering devices. By this, the call acknowledgements appearing in the unblocked state on the indicator panel assume a greater power of assertion, since the passengers are told by this that the inputted or entered calls are being assigned to the next arriving car or to the departure ready existing car. With the appearance of the blocking signal, the passengers are informed that the calls are not registered and that the call input has to wait until the blocking signal disappears.

DESCRIPTION OF THE PREFERRED EMBODIMENT

Figure 1:
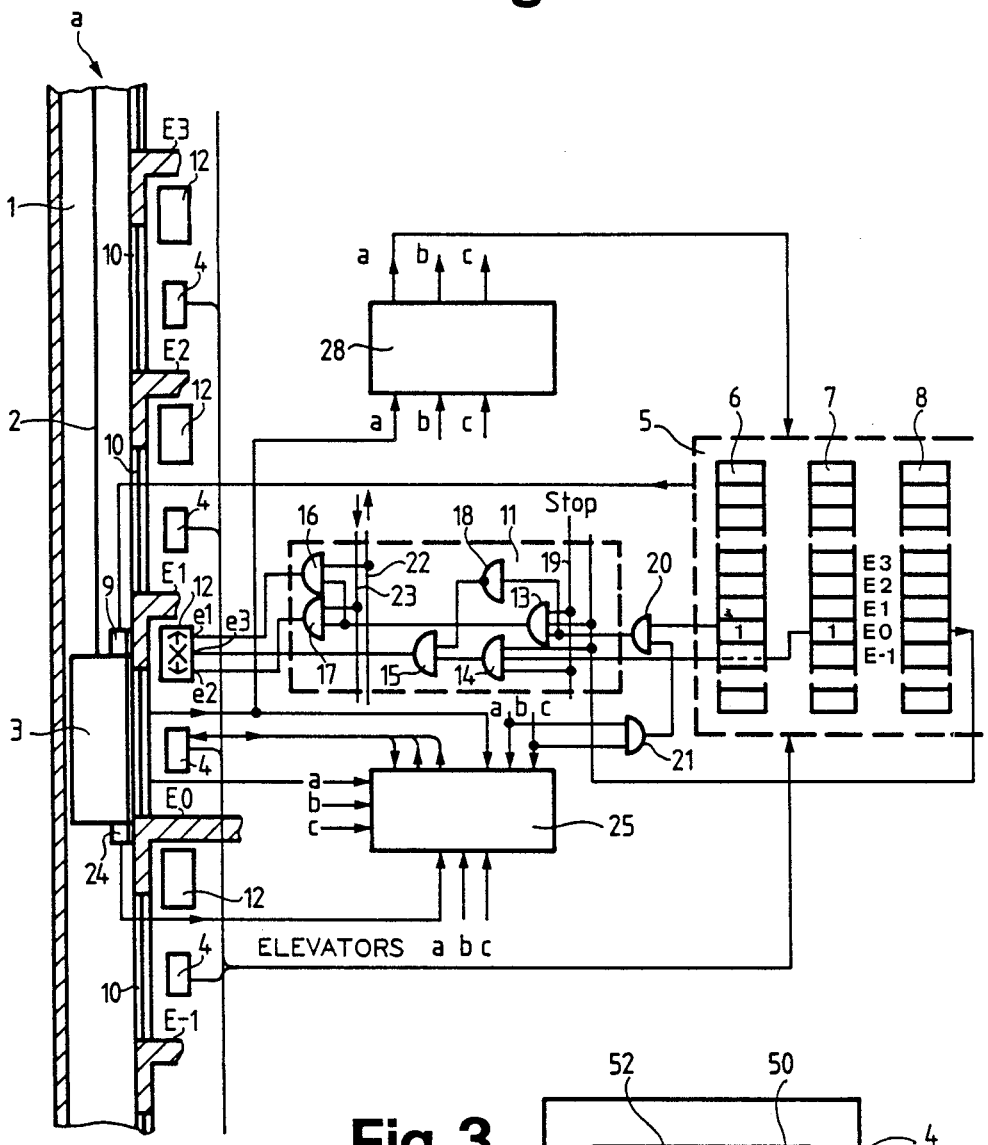
FIG. 1 is a schematic representation of an elevator in a group of elevators with a group control according to the present invention.

In FIG. 1, a part of a shaft of an elevator is shown comprising, for example, five floors E-1, EO, E1, E2 and E3 of an elevator group consisting of three elevators "a", "b", and "c". A car 3 is guided in the shaft and can be driven by a conveyor cable 2. The floor designation EO is assigned to the ground floor, which in the subsequent description is also called the main floor. Provided at the floors are call registering devices 4 which, for example, exhibit call buttons arranged in the form of a ten-key keyboard 51 (FIG. 3), by means of which calls for travels or trips to desired destination floors can be inputted. With the input of a call, a car call designating the destination floor and a floor call designating the input floor are stored. The call registering devices 4 are connected with a group control which consists of a microcomputer system 5 assigned to the elevators "a", "b", and "c", where only the part assigned to the elevator "a" is illustrated. The system 5 comprises a floor call memory 6, a car call memory 7 and a selector 8. As is known, the selector 8 signals in each case that floor at which the traveling car, in the presence of a stopping command, could still stop.

According to the customary symbolic logic, the calls stored in the floor call memory 6 and the car call memory 7 are designated by a logic "1". The group control which, for example, is similar to the group control equipment disclosed in the European Pat. No. 0,032,213, works under normal operation in such a manner, that freshly arriving calls are in each case assigned to those cars which can service these calls in the shortest possible time. Besides the normal operating program, the group control equipment also includes a control program for the upward peak traffic, which proceeds in a manner similar to the above described state of the art. During the upward peak traffic, the calls entered at the main floor EO are assigned, as described in more detail in the following, to the first arriving car or an already present car with open doors.

The car 3 has a door drive 9 by means of which the car door and, with a not illustrated follower system, joinable shaft doors 10 can be actuated. For the purpose of the control, the door drive 9 is connected with the microcomputer system 5 of the respective elevator.

Floor signaling circuits 11 assigned to the floors are connected on an input side with the microcomputer system 5 and on an output side with indicators 12 which are arranged on the floors, preferably above the shaft doors 10. The signaling circuit 11 shown for the main floor EO consists of a first and a second AND gate 13 and 14 each having three inputs, third, fourth and fifth AND gates 15, 16 and 17 each having two inputs, and a NOT gate 18. The first and second AND gates 13 and 14 each are connected by way of an input with an output of the selector 8 assigned to the respective floor, and each by way of another input with a conductor 19, which at the stop at a floor carries a "Stop" signal. A third input of the first AND gate 13 is connected to the output of an AND gate 20 having two inputs, the one input of which is connected with the output of the storage element of the floor call memory or register 6 assigned to the main floor EO. The other input of the AND gate 20 is connected to an output of an AND gate 21 having two inputs each connected to an output of a door information emitter 26 (FIG. 2) of the shaft doors 10 of one of the elevators "b" and "c".

The third input of the second AND gate 14 is connected with the output of the storage element of the car memory or register 7 assigned to the main floor EO. The output of the first AND gate 13 is connected with an input of each of the fourth and fifth AND gates 16 and 17. The other input of the fourth AND gate 16 is connected to a conductor 22 carrying an upward continued travel signal, while the other input of the fifth AND gate 17 is connected with a conductor 23 carrying a downward continued travel signal. The output of the fourth AND gate 16 is connected with a first input "e1", and the output of the fifth AND gate 17 is connected with a second input "e2" of the indicator 12. The one input of the third AND gate 15 is connected to the output of the second AND gate 14, while the other input, through the NOT-gate 18 and the AND gate 20, is in connection with the output of the storage element of the floor call memory or register 6 assigned to the main floor EO. The output of the third AND gate 15 is connected with a third input "e3" of the indicator 12.

The indicator 12, as shown in FIG. 1, consists of a first and a second indicator element in the form of an upward and respectively a downward arrow, and of a third indicator element signaling an entry prohibition, in the form of an X-sign. The indicator elements are formed by light emitting diodes (LED's), which are attached to a printed circuit board, which is not illustrated in detail, and which LED's are covered by means of a plate perforated according to the indicator symbols. On activation of the indicator elements by way of the respective inputs "e1", "e2" and e"3", the first and second indicator elements light up green, and the third indicator element lights up red. The indicator elements are activated on arrival of a car at a floor and deactivated on door closure of the respective car.

A car position transmitter 24 assigned to the main floor EO, the cooperating parts of which are attached to the car 3 and in the shaft 1, is connected with a blocking circuit 25, described subsequently in more detail with the aid of FIG. 2. The blocking or inhibiting circuit 25 is furthermore connected with the door information transmitters 26 (FIG. 2) and the call registering devices 4 of the main floor EO. Assigned to the shaft doors 10 of the main floor EO are pulse transmitters 27 (FIG. 2) which generate a pulse shortly before the start of the door closure, and which are likewise connected with the blocking or inhibiting circuit 25. By means of the blocking circuit 25, it is possible to block or inhibit the input of calls at the main floor EO during a time interval dependent on the start of the door closure and on the time of departure of the respective car.

Figure 2:
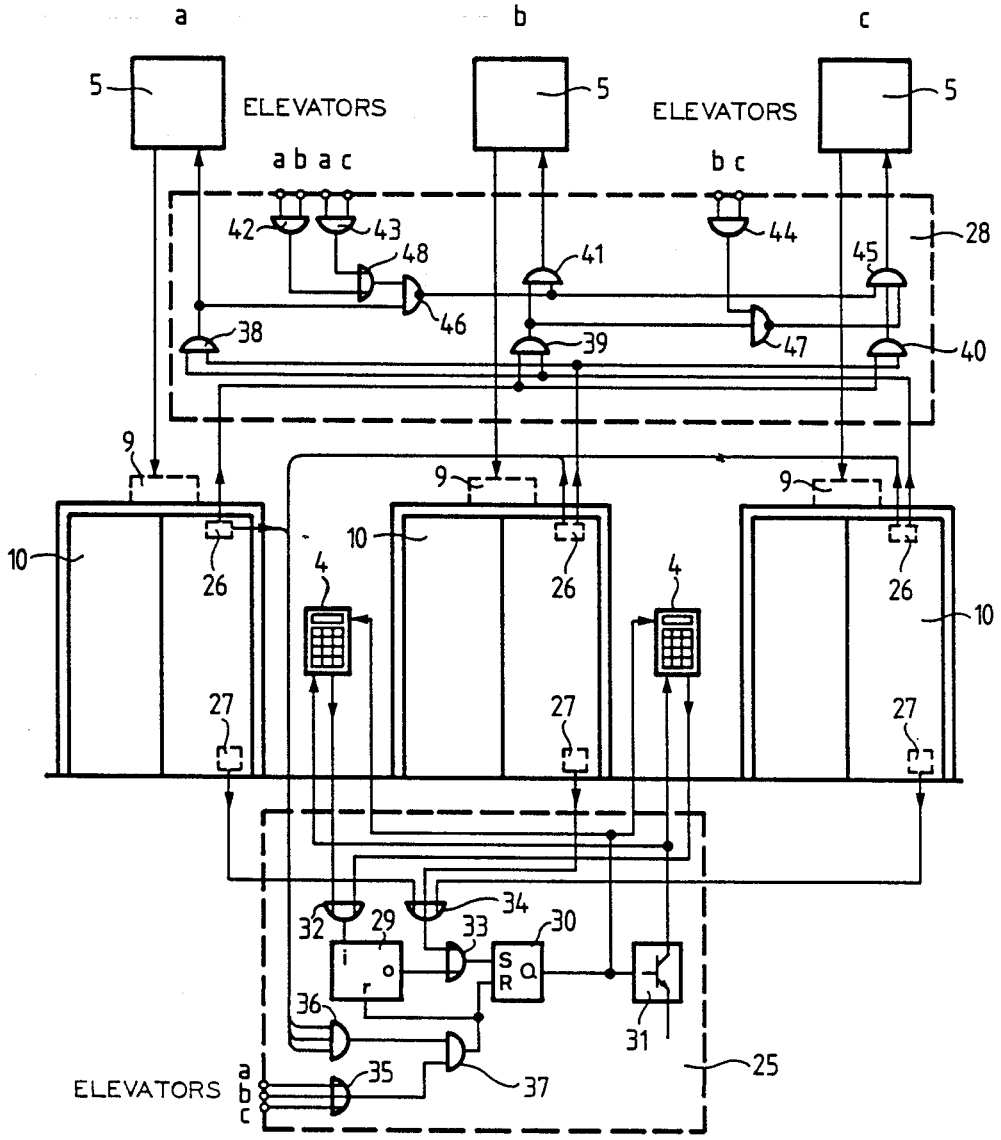
FIG. 2 is a locking and blocking circuit included in the control according to FIG. 1 for the main floor of a group of three elevators.

A locking circuit 28, which is subsequently explained in more detail with the aid of FIG. 2, is connected at its inputs with the door information transmitters 26 of the shaft doors 10 of the main floor EO and on its output side with the microcomputer systems 5 of the elevators "a", "b" and "c". The locking circuit 28, at simultaneous arrival or simultaneous presence of several cars at the main floor EO due to floor calls, only allows the doors of one elevator to be opened.

As shown in FIG. 2, the blocking or inhibiting circuit 25 consists of a counter 29, and RS flip flop 30, a transistor switch 31, first and second OR gates 32 and 33 each two inputs, third and fourth OR gates 34 and 35 each having three inputs, a first AND gate 36 having three inputs and a second AND gate 37 having two inputs. For the purpose of counting the entered calls, a clock input "i" of the counter 29 is connected to an output of the first OR gate 32 having two inputs connected to the call registering devices 4. A transfer output "o" of the counter 29 is connected to one input of the second OR gate 33 having an output connected to a set terminal "S" of the RS flip flop 30. The other input of the second OR gate 33 is in connection with an output of the third OR gate 34 having its inputs connected with the pulse transmitters 27.

An output "Q" of the RS flip flop 30 is connected on the one hand with an indicator element 52 (FIG. 3) of the call registering devices 4 and on the other hand with the control circuit of the transistor switch 31, by means of which the power supply to the call buttons on the call registering devices 4 can be interrupted. A reset terminal "R" of the RS flip flop 30 is connected with an output of the second AND gate 37, the one input of which is connected to an output of the first AND gate 36 having its inputs connected to the door information transmitters 26. The other input of the AND gate 37 is connected to an output of the fourth OR gate 35 having its inputs connected to the car position transmitters 24 (FIG. 1) of the elevators "a", "b" and "c". The output of the second AND gate 37 is also connected with a reset terminal "r" of the counter 29.

The blocking circuit 28 consists of first through seventh AND gates 38 through 44 each having two inputs, an eighth AND gate 45 having three inputs, first and second NAND gates 46 and 47 and an OR gate 48. The first, second and third AND gates 38, 39 and 40 are assigned to the shaft doors 10 of the elevators "a", "b" and "c", where the inputs of the first AND gate 38 are connected with the door information transmitters 26 of the shaft doors 10 of the elevators "b" and "c", the inputs of the second AND gate 39 are connected with the door information transmitters 26 of the shaft doors 10 of the elevators "a" and "c", and the inputs of the third AND gate 40 are connected with the door information transmitters 26 of the shaft doors 10 of the elevators "a" and "b". An output of the first AND gate 38 is connected with an input of the microcomputer system 5 assigned to the elevator "a", and to an input of the first NAND gate 46 having an output connected with one of the inputs of each of the fourth and eighth AND gates 41 and 45. An output of the second AND gate 39 is connected to the other input of the fourth AND gate 41, the output of which is in connection with an input of the microcomputer system 5 assigned to the elevator "b". An output of the third AND gate 40 is connected with another input of the eighth AND gate 45 which has its output connected to an input of the microcomputer system 5 assigned to the elevator "c". The third input of the eighth AND gate 45 is connected to an output of the second NAND gate 47 having an input connected to the output of the second AND gate 39. The fifth, sixth and seventh AND gates 42, 43 and 44 are connected on their input sides with not further illustrated shaft switches arranged in the elevator shafts, where the gate 42 is connected with the shaft switches of the elevators "a" and "b", the gate 43 with the shaft switches of the elevators "a" and "c" and the gate 44 with the shaft switches of the elevators "b" and "c". The outputs of the fifth and sixth AND gates 42 and 43 are connected through the OR gate 48 to an input of the first NAND gate 46. The output of the seventh AND gate 44 is in connection with an input of the second NAND gate 47.

Figure 3:
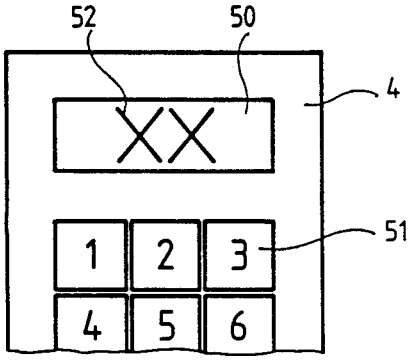
FIG. 3 is a fragmentary view of a call registering device shown in FIG. 1.

As shown in FIG. 3, the call registering device 4 includes an indicator panel 50 which responds to the input of calls by means of the call buttons of the ten-key keyboard 51 by displaying the call acknowledgement in the form of a decimal number. The presentation of the decimal number can, for example, take place by an electronic indicating device in the form of a seven segment indicator with light emitting diodes (LED's). Designated by 52 is a further indicator element in the form of an XX-sign signaling the blocking of the call registering device 4, which is likewise formed by light emitting diodes (LED's) and which can be activated by means of the blocking circuit 25 to light up red.

The group control described in the preceding works in the following manner: upon switching on the control program for the upward peak traffic, the blocking circuit 25 and the locking circuit 28 are activated and the cars are called to the main EO by simulated floor calls. Here it should be assumed that the car of the elevator "a" arrives first at the main floor EO and opens the doors. According to the selected logic, for example, the respective door information transmitter 26 will generate a door information logic "0" corresponding to the open state, so that the microcomputer systems 5 of the elevators "b" and "c" are supplied a locking information logic "0" by AND gates 39, 41, 40 and 45 preventing the start of the door control program such that a later arriving car of these elevators will not open the doors. At the simultaneous arrival of, for instance, the cars of the elevators "a" and "b" at the main floor EO, the assigned shaft switches are actuated shortly before start of the door opening, so that a logic "1" appears at the output of the AND gate 42 and a logic "0" at the output of the NAND gate 46. Thus, the locking information supplied through the AND gates 41 and 45 to the microcomputer systems 5 of the elevators "b" and "c" becomes logic "0". Since the door information signals at the closed doors are logic "1", the microcomputer system 5 of the elevator "a" is supplied through the AND gate 38 a locking information logic "1" so that the door control program can be started on this elevator.

Now let the door control program initiate the opening of the doors just prior to the arrival at the main floor EO. After the doors have been opened completely, they are kept open a predetermined time whereupon they are closed automatically and the respective car can depart. Let it now be assumed that the calls entered by the passengers at the main floor EO had been acknowledged on the indicator panels 50 (FIG. 3) of the call registering devices 4, which means that they are assigned to an arriving or already present car. As has been assumed initially, the car of the elevator "a" arrives at the main floor EO, where according to the chosen logic the selector signal, the stop signal and the upward continued travel signal are logic "1". Since the door information signals of the elevators "b" and "c" supplied to the AND gate 21 are logic "1", the first indicating element is being activated by way of the AND gate 20, the AND gates 13 and 16 of the signaling circuit 11 and the first input "e1" of the indicator 12 (FIG. 1). At that, the upward arrow of the indicator 12 of the elevator "a" lights up green, whereby it is indicated to the waiting passengers that they are allowed to enter, because the calls entered by them and acknowledged are served by this elevator.

In order that a passenger, who enters his call only towards the end of the door open holding time, has sufficient time for entry at his disposal, the call entry is only possible up to a time prior to the start of the door closure. At this point in time, a pulse is generated by the pulse transmitter 27 of the shaft door 10 of elevator "a", which pulse is supplied by way of the OR gates 34 and 33 to the set input "S" of the RS flip flop 30. By means of the signal logic "1" appearing thereupon at the output "Q" of the RS flip flop 30, the XX-signal 52 (FIG. 3) signaling the inhibiting of the call registering devices 4 is activated, so that it lights up red. Simultaneously, the transistor switch 31 is switched into the open state, whereby the power to the call buttons is interrupted and no calls are any longer acknowledged.

Within the framework of the control program for the upward peak traffic, the registered calls are now transferred into the car call memory 7 of the microcomputer system 5 of the elevator "a" and thereafter are cancelled in the call registering devices 4. After the closing of the doors of the elevator "a", the door information signals of all the elevators are logic "1", so that at the output of the AND gate 36 a logic "1" is present. Since the assigned car position transmitter 24 signals logic "1" up to the departure of the car of elevator "a", the output of the OR gate 35 is likewise logic "1", so that a short pulse is created at the output of the AND gate 37 and the RS flip flop 30 is reset. Consequently, the output "Q" will become logic "0" and the inhibiting of the call registering devices 4 is again cancelled. With the change of the door information signal of the elevator "a" to logic "1", the locking information signals at the outputs of the AND gates 41 and 45 become likewise logic "1", so that the microcomputer system 5 of the elevator "b" can start the door control program, because according to the example, the car of the elevator "b" is already present at the main floor EO.

Let it be assumed furthermore, that the number of the entered calls corresponds, prior to the point in time determined by the pulse transmitter 27, to the maximum permissible number of entering passengers. In this case, there appears at the carry output "o" of the counter 29 a signal logic "1", by means of which, by way of the OR gate 33, the RS flip flop 30 is set and the previous inhibiting of the call registering devices 4, described earlier in more detail, is released. Due to the transit time of the signals, the inhibiting is released with a delay, so that the call of the last passenger is still acknowledged before the XX-signal 52 signaling the inhibiting appears on the indicator panel 50 (FIG. 3). In the cancellation of the inhibiting of the call registering devices 4, as described in the preceding, the reset pulse occurring at the output of the AND gate 37 is also supplied to the counter 29, so that the same is reset.

According to a further example, let it be assumed that the car of elevator "b" is at the main floor EO with open doors and the car of elevator "a" arrives with a passenger who would like to get out of the car at the main floor EO. In this case, the microcomputer system 5 of the elevator "a" ignores the locking information logic "0", so that the doors are opened and, after the passenger has gotten out, are immediately closed again. On arrival of the car of elevator "a", the selector signal, the stop signal and the output of the storage element of the car call memory 7 assigned to the main EO are logic "1". Since the door information signal of the elevator "b" supplied to the AND gate 21 and thus the output of the AND gate 20 are logic "0", the X-signal is activated by way of the AND gate 14, the NOT gate 18, the AND gate 15 and the third input "e3" of the indicator 12, which X-signal will now light up red (FIG. 1). By this it is indicated to the passengers waiting at the main floor EO, that they are not permitted to enter into the car of the elevator "a", because the calls entered by them are not assigned to this car, but to the earlier arrived car of the elevator "b".

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A group control for the distribution of traffic at a main floor in elevator groups with cars accessible through automatically operatable doors and having control programs for the operation of doors and for upward peak traffic, and call registering devices for the input of calls for desired destination floors arranged on the floors, the group control comprising:

a locking circuit having an input connected to door information transmitters associated with at least two elevators of an elevator group and an output connected to a group control apparatus and responsive to a presence of several cars at a main floor for opening only the doors of one elevator and assigning calls entered at the main floor to said elevator;

a blocking circuit having an input connected to pulse transmitters of shaft doors, to call registering devices at the main floor, to said door information transmitters and to car position transmitters assigned to the main floor, and connected at an output to said call registering devices, for inhibiting said call registering devices for a retention cycle for a time dependent on the start of the door closing or after the input of a predetermined number of calls and for releasing said call registering devices at the end of said retention cycle on the departure of the respective car; and an indicating element connected to an output of said blocking circuit for signaling the inhibiting of said call registering devices during said retention cycle.

2. The control according to claim 1 wherein said indicator element is in the form of an XX-sign and is arranged in an indicator panel of said call registering devices.

3. The control according to claim 1 wherein said indicator element is formed of light emitting diodes, which on activation light up red.

4. The control according to claim 1 wherein said blocking circuit includes a counter, an RS flip flop, a transistor switch, a first and second OR gate each having two inputs, a third and fourth OR gate each having three inputs, a first AND gate having three inputs and a second AND gate having two inputs, wherein a clock input of said counter is connected through said first OR gate with said call registering devices and a transfer output of said counter is connected to one input of said second OR gate having an output connected to a set terminal of said RS flip flop and another input of said second OR gate connected through said third OR gate to said pulse transmitters, an output of said RS flip flop is connected to said indicator element and to a control circuit of said transistor switch, so that on setting of said RS flip flop, said indicator element is activated and power to call buttons of said call registering devices is interrupted by said transistor switch, whereby said call registering devices are inhibited, and a reset terminal of said RS flip flop is connected to an output of said second AND gate, one input of which is connected through said first AND gate to said door information transmitters and another input of which is connected through said fourth OR gate to said car position transmitter, where, on closing of the door and departure of the respective car, said RS flip flop is reset and the inhibiting of said call registering devices is cancelled.

5. The control according to claim 4 wherein said RS flip flop is set by a pulse of said pulse transmitter generated a predetermined time before the closing of the door.

6. The control according to claim 4 wherein said RS flip flop is set by a pulse appearing at said transfer output of said counter, which pulse is generated on input of a number of calls corresponding to the maximum load of the car.

7. The control according to claim 1 including microcomputer systems assigned to each of the elevators and wherein said locking circuit includes first through seventh AND gates each having two inputs, an eighth AND gate having three inputs, first and second NAND gates and an OR gate, said first, second and third AND gates being assigned to the shaft doors of each of three elevators, said inputs of said AND gates being connected in each case with said door information transmitters of the elevators not assigned to them, an output of said first AND gate being connected with said microcomputer system of a first elevator and by way of said first NAND gate with one input of each of said fourth and eighth AND gates, an output of said second AND gate is connected to the other input of said fourth AND gate, the output of which is connected to the microcomputer system of the second elevator, an output of said third AND gate is connected with another input of said eighth AND gate, the output of which is connected with the microcomputer system of said third elevator, a further input of said eighth AND gate is connected by way of said second NAND gate with the output of said second AND gate, said fifth, sixth and seventh AND gates are connected at inputs with said shaft switches of the first and second elevators, of the first and third elevators, and of the second and third elevators respectively, and outputs of said fifth and sixth AND gates are connected by way of said OR-gate to an input of said first NAND gate, and an output of said seventh AND gate is connected with one input of said second NAND gate on arrival of a car at the main floor and opening of the doors, a locking information signal preventing the start of the door control program is generated and supplied to said microcomputer systems of the other elevators, and where at simultaneous arrival of several cars at said main floor, said locking information signal preventing the start of the door control program is generated prior to the opening of the doors for the elevators of lower priority and is supplied to the microcomputer systems of these elevators.

8. In an elevator control system for a group of elevator cars having a group control with control programs for the operation of doors and for upward peak traffic, call registering devices for the input of calls at a main floor, door information transmitters and shaft switches for each elevator, and pulse transmitters for the elevator shaft doors, a circuit comprising:

a locking circuit having an input connected to door information transmitters of all cars in a group of elevator cars and an output connected to a group control means for the cars, and responsive to the presence of at least two cars at a main floor for opening only the doors of one elevator car and for assigning calls entered at a main floor call registering device to said one car;

a blocking circuit having inputs connected to pulse transmitters for each of the car doors, to said main floor call registering device, to door information transmitters for the cars and to shaft switches for the cars at the main floor, and an output connected to said main floor call registering device for inhibiting said main floor call registering device for a retention cycle initiated by a pulse from said pulse transmitters at the start of door closing and ended by a signal from said shaft switches when the car departs; and an indicating element means connected to said main floor call registering device for signaling the inhibiting of calls during the retention cycle in response to a signal generated by said blocking circuit.

9. The circuit according to claim 8 wherein the retention cycle is initiated by a predetermined number of calls generated from said main floor call registering means.

10. The circuit according to claim 8 wherein said indicating element means is in the form of an XX-sign and is connected to an output of said blocking circuit.

* * * * *